US011498809B2

(12) United States Patent
Pusala et al.

(10) Patent No.: US 11,498,809 B2
(45) Date of Patent: Nov. 15, 2022

(54) ELEVATOR SYSTEM WITH THERMAL SENSORS

(71) Applicant: Otis Elevator Company, Farmington, CT (US)

(72) Inventors: Rajinikanth Pusala, Telangana (IN); Sudharshan Karanam, Telangana (IN); Prasad Babu Lakshmipathy, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 678 days.

(21) Appl. No.: 16/543,249

(22) Filed: Aug. 16, 2019

(65) Prior Publication Data

US 2020/0055703 A1 Feb. 20, 2020

(30) Foreign Application Priority Data

Aug. 17, 2018 (IN) ..... 201811030870

(51) Int. Cl.

| | |
|---|---|
| ***B66B 11/00*** | (2006.01) |
| ***B66B 1/34*** | (2006.01) |
| ***B66B 5/00*** | (2006.01) |
| ***B66B 5/28*** | (2006.01) |

(52) U.S. Cl.

CPC ..... *B66B 11/0005* (2013.01); *B66B 1/3446* (2013.01); *B66B 5/0031* (2013.01); *B66B 11/001* (2013.01); *B66B 5/284* (2013.01)

(58) Field of Classification Search

CPC . B66B 11/0005; B66B 1/3446; B66B 5/0031; B66B 11/001; B66B 5/284; B66B 5/024; B66B 1/3461; B66B 3/00

See application file for complete search history.

(56) References Cited

U.S. PATENT DOCUMENTS

| | | | | |
|---|---|---|---|---|
| 2015/0304575 | A1 | 10/2015 | Sacknoff et al. | |
| 2018/0093859 | A1 | 4/2018 | Stranieri et al. | |
| 2018/0093861 | A1 | 4/2018 | Stranieri et al. | |
| 2018/0162690 | A1 | 6/2018 | Hsu et al. | |
| 2019/0135581 | A1* | 5/2019 | Beaubois | B66B 5/024 |
| 2019/0239258 | A1* | 8/2019 | Ginsberg | H04W 92/18 |

FOREIGN PATENT DOCUMENTS

| | | |
|---|---|---|
| CN | 2445309 Y | 8/2001 |
| CN | 1200869 C | 5/2005 |
| CN | 1805895 A | 7/2006 |

(Continued)

OTHER PUBLICATIONS

European Patent Office, Extended European Search Report, Application No. 19192165.9-1017, dated Jan. 27, 2020 (8 pp.).

(Continued)

*Primary Examiner* — Jeffrey Donels

(74) *Attorney, Agent, or Firm* — Cantor Colburn LLP

(57) ABSTRACT

Disclosed is an elevator system having a first sensor in communication with an elevator in a multi-level hoistway, wherein during an emergency the elevator instructs the first sensor to sense conditions and transmit sensor data representing the sensed conditions, and the transmitted sensor data is processed to obtain an image representing an intensity of hazard conditions on at least a subset of levels serviced by the multilevel hoistway.

18 Claims, 4 Drawing Sheets

(56) References Cited

FOREIGN PATENT DOCUMENTS

| | | | |
|---|---|---|---|
| CN | 101048308 | A | 10/2007 |
| CN | 100364872 | C | 1/2008 |
| CN | 101959785 | A | 1/2011 |
| CN | 102190228 | A | 9/2011 |
| CN | 103038150 | A | 4/2013 |
| CN | 103204418 | A | 7/2013 |
| CN | 103224172 | A | 7/2013 |
| CN | 205222338 | U | 5/2016 |
| CN | 205932807 | U | 2/2017 |
| CN | 106744102 | A | 5/2017 |
| CN | 206278794 | U | 6/2017 |
| CN | 107055230 | A | 8/2017 |
| CN | 107954291 | A | 4/2018 |
| CN | 107986120 | A | 5/2018 |
| CN | 108053599 | A | 5/2018 |
| DE | 10102936 | A1 | 7/2002 |
| EP | 3483103 | A1 | 5/2019 |
| JP | 2001253660 | A | 9/2001 |
| JP | 2006131409 | A | 5/2006 |
| JP | 2008290842 | A | 12/2008 |
| JP | 2010265103 | A | 11/2010 |
| JP | 2011063423 | A | 3/2011 |
| JP | 20121289 | A | 1/2012 |
| JP | 2017001870 | A | 1/2017 |

OTHER PUBLICATIONS

Chinese Office Action for CN Application No. 201910757378.9, dated Sep. 3, 2020, pp. 1-9.

Chinese Office Action Issued in Chinese Application No. 201910757378.9 dated Mar. 29, 2021; 9 Pages.

Shupert, Steve; "Using Thermal Imaging Cameras"; Nov. 2011; Retrieved from the Internet on Jul. 2, 2018; Url: https://www.fireengineering.com/articles/print/volume-164/issue-11/departments/training-notebook/using-thermal-imaging-cameras.html; 5 pages.

* cited by examiner

ELEVATOR SYSTEM WITH THERMAL SENSORS

CROSS-REFERENCE TO RELATED APPLICATION

This application claims the benefit of Indian Patent Application No. 201811030870 filed Aug. 17, 2018, which is incorporated herein by reference in its entirety.

BACKGROUND

The embodiments herein relate to elevator systems and more specifically to an elevator system with thermal sensors.

During fires, emergency elevators may be used by authorized persons to reach various floors for different reasons including a physical inspection of fire intensity and evacuation and suppression planning. This process is time consuming and hazardous to the persons executing the inspection.

BRIEF SUMMARY

Disclosed is an elevator system comprising a first sensor in communication with an elevator in a multi-level hoistway, wherein during an emergency the elevator instructs the first sensor to sense conditions and transmit sensor data representing the sensed conditions, and the transmitted sensor data is processed to obtain an image representing an intensity of hazard conditions on at least a subset of levels serviced by the multilevel hoistway.

In addition to one or more features and elements disclosed in this document or as an alternate the system includes a plurality of sensors including the first sensor and a second sensor, the first sensor in communication with the elevator and the second sensor in communication with an elevator counterweight in the hoistway, wherein during an emergency the elevator instructs the plurality of sensors to sense conditions and transmit sensor data representing the sensed conditions, and the transmitted sensor data is processed to obtain at least one image of the intensity of the hazard conditions on at least a subset of levels serviced by the multilevel hoistway.

In addition to one or more features and elements disclosed in this document or as an alternate the plurality of sensors are thermal sensors.

In addition to one or more features and elements disclosed in this document or as an alternate the at least one thermal image is displayed on a call panel for the elevator.

In addition to one or more features and elements disclosed in this document or as an alternate the at least one thermal image is transmitted over the network and displayed at least one electronic display.

In addition to one or more features and elements disclosed in this document or as an alternate the at least one thermal image is transmitted over the network for storage at an electronic storage server.

In addition to one or more features and elements disclosed in this document or as an alternate the at least one electronic display obtains the at least one thermal image from the electronic storage server.

In addition to one or more features and elements disclosed in this document or as an alternate the elevator receives the sensor data from the plurality of sensors, prepares the at least one thermal image of hazard conditions, and transmits the at least one thermal image to one or more of the elevator call panel, the electronic displays and the electronic storage server.

In addition to one or more features and elements disclosed in this document or as an alternate the electronic storage server is a content management system (CMS).

In addition to one or more features and elements disclosed in this document or as an alternate a protocol suit for communicating with the CMS includes Transmission Control Protocol (TCP) and Internet Protocol (IP) (TCP/IP).

Further disclosed is a method of operating an elevator system, the system including one or more features and elements disclosed in this document.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
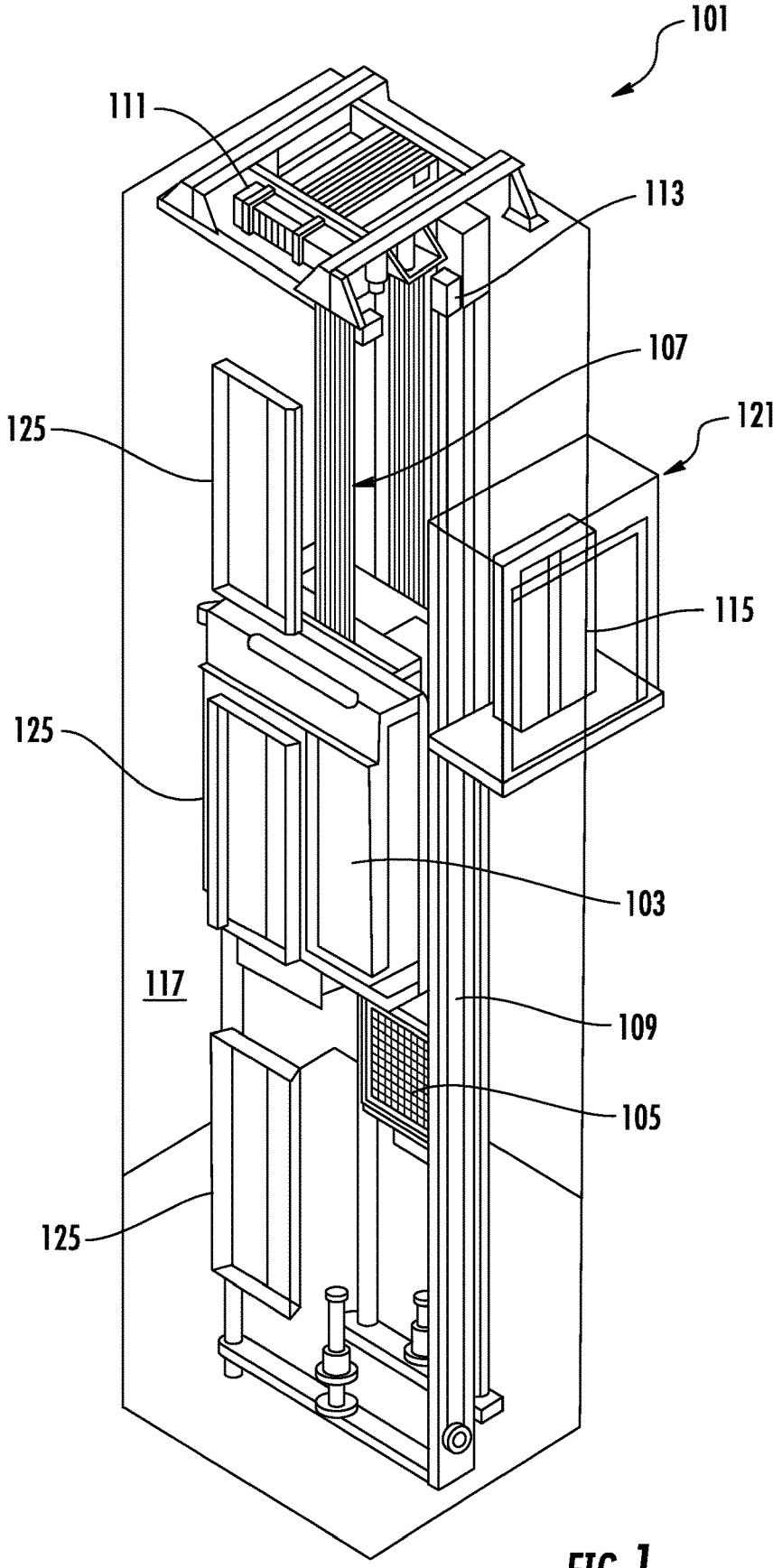
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counterweight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

FIGS. 2-5 illustrate additional technical features associated with one or more disclosed embodiments. Features and elements disclosed in FIGS. having nomenclature and/or illustrative appearance that is the same or similar to that in FIG. 1 may be similarly construed even though nomenclature and/or numerical identifiers may differ.

Figure 2:
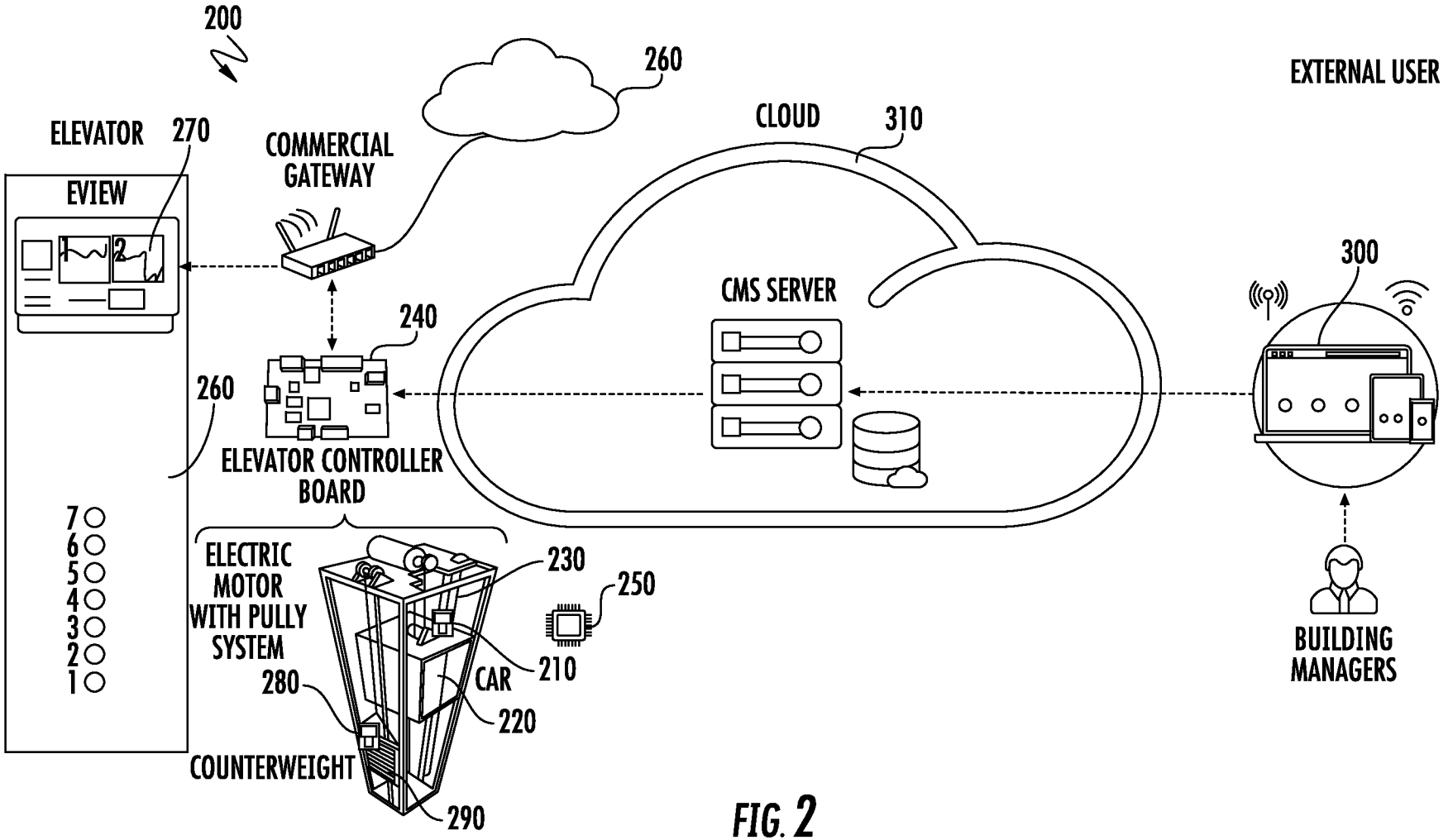
FIG. 2 illustrates components of an elevator system according to an embodiment.

Turning to FIG. 2, an elevator system 200 is disclosed. The system 200 may include a first sensor 210 in communication with an elevator 220 in a multi-level hoistway 230. Further disclosed are a plurality of controllers including an elevator controller 240 and first sensor controller 250. The plurality of controllers may communicate over a network 260. Reference in this document to operational features of the elevator 220 may also be construed as reference to the elevator controller 240 for implementing controls necessary to support such operational features. Other components and respective controllers disclosed herein shall be similarly construed.

Figure 3:
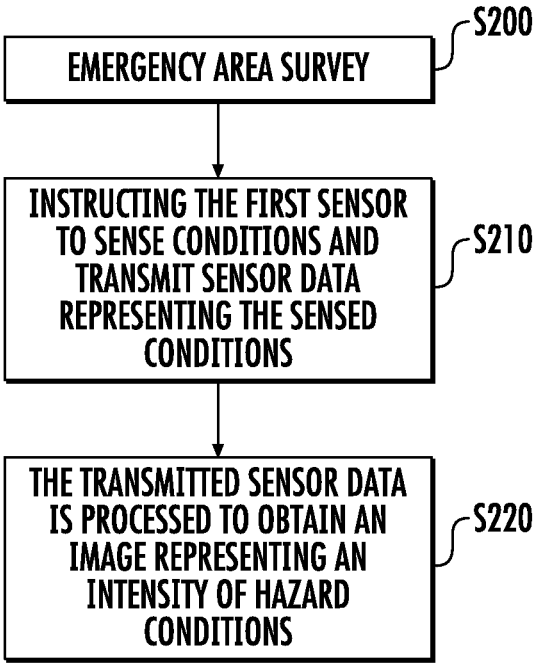
FIG. 3. illustrates a process executed by the components of FIG. 2 according to an embodiment.

Turing to FIG. 3, during an emergency the elevator 220 may perform an emergency area survey S200. Process steps are sequentially numbered in this document to facilitate discussion but are not intended to identify a specific sequence of performance of such steps or a requirement to perform such steps unless expressly indicated.

The process S200 may include the elevator 220 performing step S210 of instructing the first sensor 210 to sense conditions and transmit sensor data representing the sensed conditions. At step S220, the transmitted sensor data may be processed to obtain an image 270 representing an intensity of hazard conditions on at least a first subset of levels serviced by the multilevel hoistway 230.

Turning back to FIG. 2, the system 200 may comprise a plurality of sensors including the first sensor 210 and a second sensor 280. The first sensor 210 may be in communication with the elevator 220 and the second sensor 280 may be disposed on an elevator counterweight 290 in the hoistway 230. The plurality of controllers may include a plurality of sensor controllers, where the plurality of sensor controllers may include at least the first sensor controller 250. Each of the plurality of sensors may include a respective one of the plurality of sensor controllers. For facilitating disclosure of the embodiments, the plurality of sensors and plurality of sensor controllers may be sequentially paired, so that the first senor is paired with the first sensor controller. However, the scope of the disclosure is not limited by such pairing unless expressed indicated. In addition, similarly paired features disclosed herein shall be similarly construed.

Figure 4:
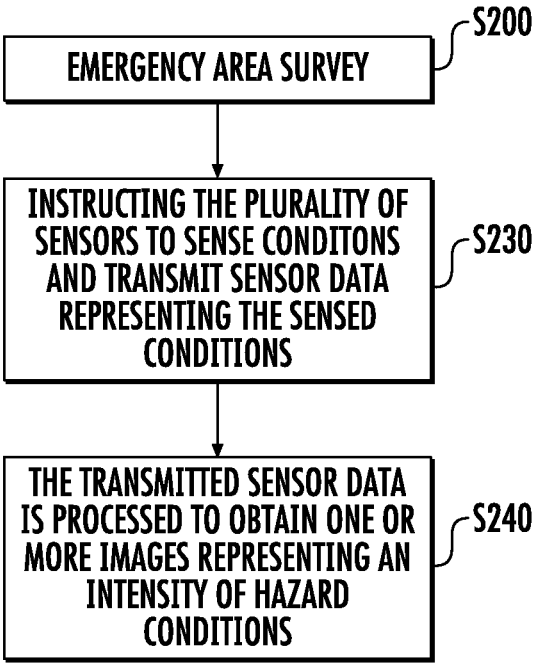
FIG. 4. illustrates another process executed by the components of FIG. 2 according to an embodiment.

Turning to FIG. 4, the emergency area survey S200 is further illustrated wherein during an emergency the elevator 220 may perform step S230 of instructing the plurality of sensors to sense conditions and transmit sensor data representing the sensed conditions. Under step S240, the transmitted sensor data may be processed to obtain at least one image 270 of the intensity of the hazard conditions on at least a subset of levels serviced by the multilevel hoistway 230. For example a single image 270 comprising the processing of all data may be provided to give a more detailed image of sensed conditions.

Turning back to FIG. 2, according to an embodiment, the plurality of sensors may be thermal sensors. According to an embodiment, the at least one thermal image 270 may be displayed on a call panel 275 for the elevator 220. According to an embodiment the at least one thermal image may be transmitted over the network 260 and displayed at least one electronic display 300. According to an embodiment the at least one thermal image 270 may be transmitted over the network 260 for storage in an electronic storage server 310. According to an embodiment the at least one electronic display 300 may obtain the at least one thermal image 270 from the electronic storage server 310.

Figure 5:
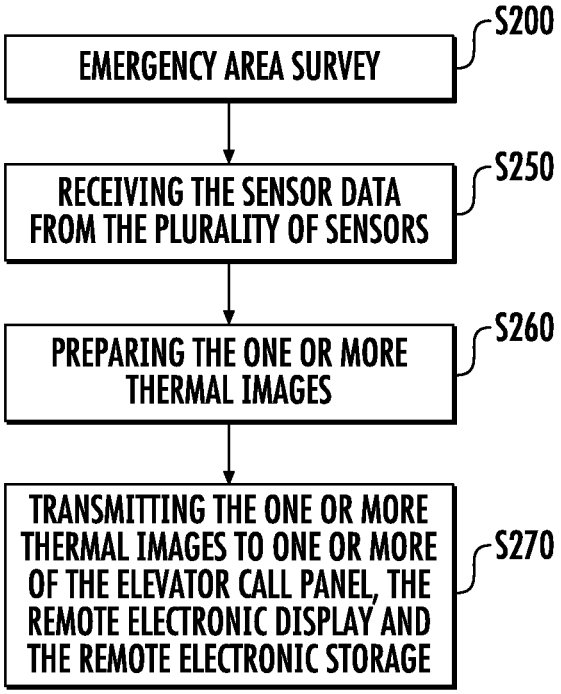
FIG. 5. illustrates another process executed by the components of FIG. 2 according to an embodiment.

Turning to FIG. 5, the emergency area survey S200 may include step S250 of the elevator 220 receiving the sensor data from the plurality of sensors. The elevator 220 may perform step S260 of preparing the at least one thermal image 270. The elevator 220 may then perform step S270 transmitting the at least one thermal image 270 to one or more of the elevator call panel 275, the electronic display 300 and the electronic storage server 310.

According to an embodiment the electronic storage server 310 may be a content management system (CMS). According to an embodiment a protocol suite for communicating with the storage server 310 may include Transmission Control Protocol (TCP) and Internet Protocol (IP) (TCP/IP).

The above disclosed embodiments may help for emergency evacuation and fire suppressing planning during an emergency. The disclosed embodiments provide an arrangement of thermal cameras, which may be mounted on top of an elevator car and on a counterweight. The thermal cameras may be electronically controlled by individual controllers, and which may receive operational instructions from an elevator controller.

The disclosed embodiments may provide first responders with a plan for better evacuation and fire suppressing. The embodiments may include an arrangement of thermal cameras mounted on top car and top counterweight, which may be controlled by an electronic module or controller which in turn is in communication with or is part of the elevator controller. During an active fire alarm the elevator may move to a predetermined discharge floor. During this time, the mounted thermal cameras may capture thermal radiation information of the various elevator lobbies and transfer to, for example, a server located on the World Wide Web (Internet) using a CMS (content management system). The stored thermal information may be displayed using an electronic-display and the stored thermal information may be transferred to a building management service (BMS) or a personal mobile device to view remotely. In addition notification may be sent to first responders along with thermal information for the responders to sense a severity of the hazard.

Benefits of the disclosed embodiments may include safety for those persons otherwise seeking to obtain a physical inspection of various elevator lobbies for thermal radiation information. Dynamic thermal radiation information of various elevator lobbies may allow first responders to utilize relatively quick and safe evacuation and fire suppression plans. A BMS may dynamically view the thermal radiation information which may serve as a guide for first responders for effective evacuation and fire suppression.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system comprising:

a first sensor in communication with an elevator in a multi-level hoistway, wherein during an emergency the elevator instructs the first sensor to sense conditions and transmit sensor data representing the sensed conditions, and the transmitted sensor data is processed to obtain an image representing an intensity of hazard conditions on at least a subset of levels serviced by the multi-level hoistway; and a plurality of sensors including the first sensor and a second sensor, the first sensor in communication with the elevator and the second sensor in communication with an elevator counterweight in the hoistway, wherein during an emergency the elevator instructs the plurality of sensors to sense conditions and transmit sensor data representing the sensed conditions, and the transmitted sensor data is processed to obtain at least one image of the intensity of the hazard conditions on at least a subset of levels serviced by the multilevel hoistway.

2. The system of claim 1 wherein the plurality of sensors are thermal sensors.

3. The system of claim 1 wherein the at least one thermal image is displayed on a call panel for the elevator.

4. The system of claim 3 wherein the at least one thermal image is transmitted over the network and displayed on at least one electronic display.

5. The system of claim 4 wherein the at least one thermal image is transmitted over the network for storage at an electronic storage server.

6. The system of claim 5 wherein the at least one electronic display obtains the at least one thermal image from the electronic storage server.

7. The system of claim 5 the elevator is configured to:

receive the sensor data from the plurality of sensors;

prepares the at least one thermal image of hazard conditions; and transmit the at least one thermal image to one or more of the elevator call panel, the electronic displays and the electronic storage server.

8. The system of claim 5 wherein the electronic storage server is a content management system (CMS).

9. The system of claim 8 wherein a protocol suit for communicating with the CMS includes Transmission Control Protocol (TCP) and Internet Protocol (IP) (TCP/IP).

10. A method of operating an elevator system, the system including:

a first sensor in communication with an elevator in a multi-level hoistway, wherein during an emergency the elevator instructs the first sensor to sense conditions and transmit sensor data representing the sensed conditions, and the transmitted sensor data is processed to obtain an image representing an intensity of hazard conditions on at least a subset of levels serviced by the multi-level hoistway; and wherein the system comprises:

a plurality of sensors including the first sensor and a second sensor, the first sensor in communication with the elevator and the second sensor in communication with an elevator counterweight in the hoistway, wherein during an emergency the elevator instructs the plurality of sensors to sense conditions and transmit sensor data representing the sensed conditions, and the transmitted sensor data is processed to obtain at least one image of the intensity of the hazard conditions on at least a subset of levels serviced by the multilevel hoistway.

11. The method of claim 10 wherein the plurality of sensors are thermal sensors.

12. The method of claim 10 wherein the at least one thermal image is displayed on a call panel for the elevator.

13. The method of claim 12 wherein the at least one thermal image is transmitted over the network and displayed on at least one electronic display.

14. The method of claim 13 wherein the at least one thermal image is transmitted over the network for storage at an electronic storage server.

15. The method of claim 14 wherein the at least one electronic display obtains the at least one thermal image from the electronic storage server.

16. The method of claim 14 wherein the elevator:

receives the sensor data from the plurality of sensors;

prepares the at least one thermal image of hazard conditions; and transmits the at least one thermal image to one or more of the elevator call panel, the electronic displays and the electronic storage.

17. The method of claim 14 wherein the electronic storage server is a content management system (CMS).

18. The method of claim 17 wherein a protocol suit for communicating with the CMS includes Transmission Control Protocol (TCP) and Internet Protocol (IP) (TCP/IP).

* * * * *